US011441781B2

(12) United States Patent
Alberti et al.

(10) Patent No.: US 11,441,781 B2
(45) Date of Patent: Sep. 13, 2022

(54) SYSTEM OF GAS BURNERS, IN PARTICULAR FOR A COOKING TOP FOR HOUSEHOLD USE

(71) Applicant: WHIRLPOOL EMEA S.p.A., Pero (IT)

(72) Inventors: Carlo Alberti, Fabriano (IT); Alberto Gasparini, Fabriano (IT); Tiziano Lacchè, Matelica (IT)

(73) Assignee: WHIRLPOOL EMEA S.p.A., Pero (IT)

( * ) Notice: Subject to any disclaimer, the term of this patent is extended or adjusted under 35 U.S.C. 154(b) by 180 days.

(21) Appl. No.: 16/748,011

(22) Filed: Jan. 21, 2020

(65) Prior Publication Data

US 2020/0158345 A1 May 21, 2020

Related U.S. Application Data

(63) Continuation of application No. 15/227,157, filed on Aug. 3, 2016, now Pat. No. 10,578,308.

(30) Foreign Application Priority Data

Aug. 3, 2015 (EP) ..... 15179573

(51) Int. Cl.

| | |
|---|---|
| ***F24C 3/08*** | (2006.01) |
| ***F23D 14/06*** | (2006.01) |
| ***F23D 14/08*** | (2006.01) |

(52) U.S. Cl.

CPC ..... *F24C 3/08* (2013.01); *F23D 14/065* (2013.01); *F23D 14/085* (2013.01); *F23D 2203/102* (2013.01); *F23D 2213/00* (2013.01); *F23D 2900/14062* (2013.01)

(58) Field of Classification Search

CPC ..... F23C 3/08; F23D 14/065; F23D 14/085; F23D 2203/102; F23D 2213/00; F23D 2900/14062

USPC ..... 126/39 E

See application file for complete search history.

(56) References Cited

U.S. PATENT DOCUMENTS

| | | | |
|---|---|---|---|
| 1,903,032 | A | 3/1933 | Dufault |
| 6,132,205 | A | 10/2000 | Harneit |
| 2004/0253559 | A1 | 12/2004 | Schultz et al. |
| 2007/0059657 | A1 | 3/2007 | Yen |
| 2013/0087136 | A1 | 4/2013 | Ahmed |
| 2015/0107577 | A1 | 4/2015 | Jeong et al. |
| 2015/0176845 | A1 | 6/2015 | De Brosse et al. |

FOREIGN PATENT DOCUMENTS

| | | |
|---|---|---|
| EP | 2211097 | 7/2010 |
| FR | 2999276 | 6/2014 |
| WO | 9212384 | 7/1992 |
| WO | 2008104832 | 9/2008 |

*Primary Examiner* — Allen R. B. Schult
(74) *Attorney, Agent, or Firm* — Price Heneveld LLP

(57) ABSTRACT

The present device relates to a system of gas burners, in particular for a cooking top for household use and including a pair of substantially concentric burners. The pair of burners including an outer burner equipped with a first base, a first burner body and a first flame divider, and an inner burner equipped with a second base, a second burner body and a second flame divider. The present device is characterized in that the first base of the outer burner and the second base of the inner burner are made from a metallic sheet that is shaped by deep drawing.

10 Claims, 4 Drawing Sheets

SYSTEM OF GAS BURNERS, IN PARTICULAR FOR A COOKING TOP FOR HOUSEHOLD USE

CROSS-REFERENCE TO RELATED APPLICATION

The present application is a continuation of U.S. patent application Ser. No. 15/227,157 filed Aug. 3, 2016, entitled SYSTEM OF GAS BURNERS, IN PARTICULAR FOR A COOKING TOP FOR HOUSEHOLD USE, which claims priority to European Patent Application No. EP15179573.9 filed on Aug. 3, 2015, entitled SYSTEM OF GAS BURNERS, IN PARTICULAR FOR A COOKING TOP FOR HOUSEHOLD USE, the entire disclosures of which are hereby incorporated herein by reference.

FIELD OF THE DEVICE

The present device also relates to a cooking top having a gas burner.

BACKGROUND

At present, several typologies of cooking tops are available on the market, the most widespread typology using one or more gas burners, wherein the amount of heat necessary for cooking food is generated through combustion of a gas appropriately mixed with air.

Systems of burners are also known in the art, which have a substantially circular shape and have two concentric burners, typically an outer burner and an inner burner.

Such systems of burners are known as "double-crown", and include gas supply means, said supply means comprising, for example, a pair of gas inlet ducts associated with independent control valves, so that the two burners (i.e. the outer burner and the inner burner) can be used either together or separately in order to achieve good variability and a homogeneous distribution of the heat to be supplied to the cooking containers. As an alternative, both concentric burners may be fed by a single gas inlet duct, with an associated tap, which simultaneously feeds the different intake channels that supply the air-gas mixture to the concentric burners.

Such systems of burners further include a cup comprising at least one first chamber for supplying the air-gas mixture to the inner burner and at least one second chamber for supplying said air-gas mixture to the outer burner, said cup being associated with the supply means and with at least one flame divider (or cap).

The cup and the flame divider may be positioned on the cooking top where the system of burners is installed, and use the air above the cooking top as primary air to be mixed with the gas.

Also, the cup is usually made of die-cast aluminum, while the flame divider or cap is usually made of enameled cast iron (or brass alloy or steel) and acts as a cup closing element.

These systems of burners known in the art typically propagate a flame known as "crown flame"; a "crown flame" is a flame with a substantially radial direction of propagation, i.e., a flame that propagates outwards from the gas burner in a substantially radial direction with respect to the burner axis, and therefore in a direction which is substantially tangential to a visible surface of the cooking top. Said "crown flame", when emitted at an insufficient height above the cooking top, may cause low-$CO_2$ combustion, resulting in the generation of a high level of unburnt products (CO and $NO_x$).

Systems of burners are also known in the art which have a flame divider or cap with a plurality of apertures adapted to generate a "carpet flame", i.e., a flame that propagates out of the system of burners in a substantially axial direction with respect to the axis of the system of burners, and therefore in a direction which is substantially orthogonal to a visible surface of the cooking top.

A carpet flame may be a total carpet flame or a perimetric carpet flame, depending on whether it covers a geometric figure (generally a circle) entirely or just the peripheral portion of said geometric figure (generally a circular crown).

Also in the case of a perimetric carpet flame, a plurality of concentric rows of apertures can generate a "carpet flame", in particular for the purpose of optimally heating also the central portion of the base of a cooking vessel positioned over the gas burner.

However, the solutions known in the art suffer from a few drawbacks.

In particular, in the solutions known in the art, the components of the system of burners are substantially made by die casting, being typically made of die-cast aluminum alloys; it is clear that this solution is an expensive one, and therefore a cooking top comprising such a system of burners will implement solutions that are not very effective in economical terms.

Furthermore, in the solutions known in the art, the flame divider is positioned flush with the visible surface of the cooking top. When the system of burners is in use, it has been noticed that such a realization may cause overheating of that area of the visible surface of the cooking top which is closest to the system of burners; it is clear that this overheating may also cause damages to the cooking top, particularly when the latter is made from glassy materials or the like.

SUMMARY

It is an object of the present device to provide a system of gas burners, in particular for a cooking top for household use, and an associated cooking top which are adapted to overcome the drawbacks of prior-art solutions.

Consequently, it is one object of the present device to provide a system of gas burners and an associated cooking top which are so realized as to prove particularly efficient and economical.

In particular, it is one object of the present device to provide a system of gas burners which is so realized as to ensure optimal gas efficiency while at the same time lowering its production costs.

It is another object of the present device to provide a system of gas burners which is so realized as to prevent overheating of the region of the cooking top proximal to the system of burners, and to avoid possible damage to the cooking top, particularly when the latter is made from glassy materials or the like.

Said objects are achieved by the present device through a system of gas burners, in particular for a cooking top for household use, and an associated cooking top incorporating the features set out in the appended claims, which are intended to be an integral part of the present description.

BRIEF DESCRIPTION OF THE DRAWINGS

Further objects, features and advantages of the present device will become apparent from the following detailed description and from the annexed drawings, which are supplied by way of non-limiting example, wherein.

DETAILED DESCRIPTION OF EMBODIMENTS

Figure 1:
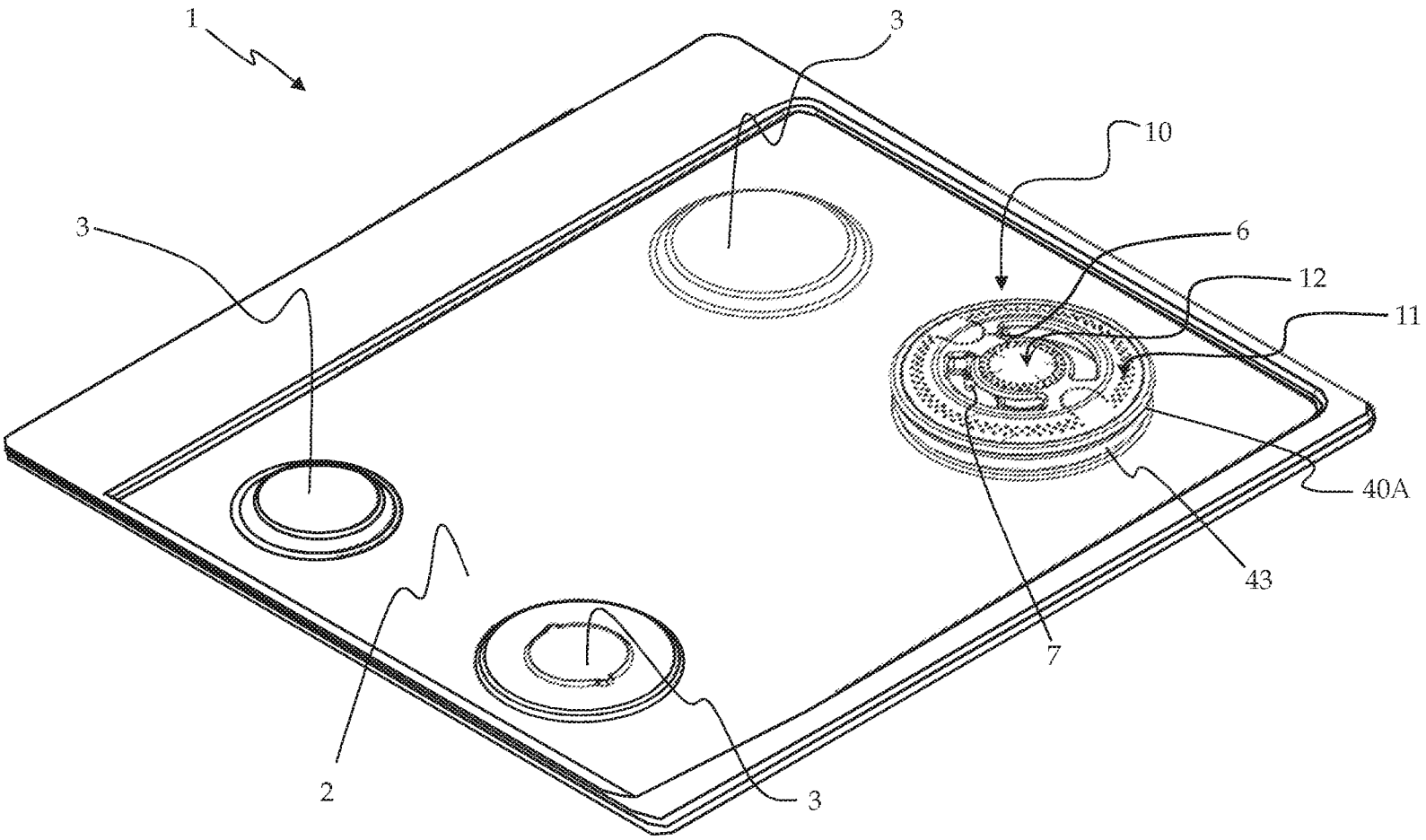
FIG. 1 is a perspective view of a cooking top and a system of gas burners making up one possible aspect of the present device.

Referring now to FIG. 1, reference numeral 1 designates a cooking top according to the present device, in particular intended for household use and of the embedded type.

Figure 2:
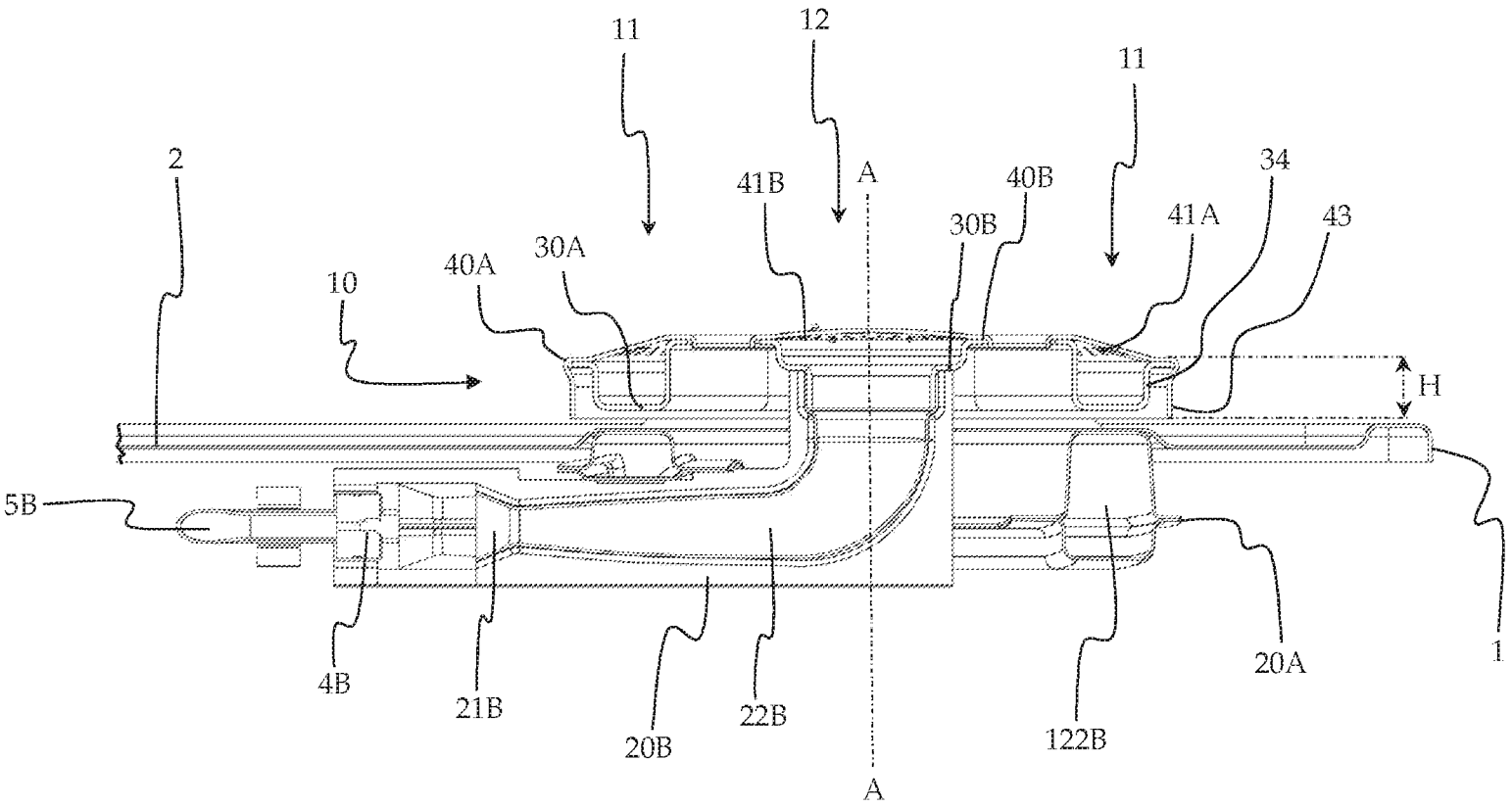
FIG. 2 is a schematic sectional view of a system of gas burners according to the present device.
Figure 3:
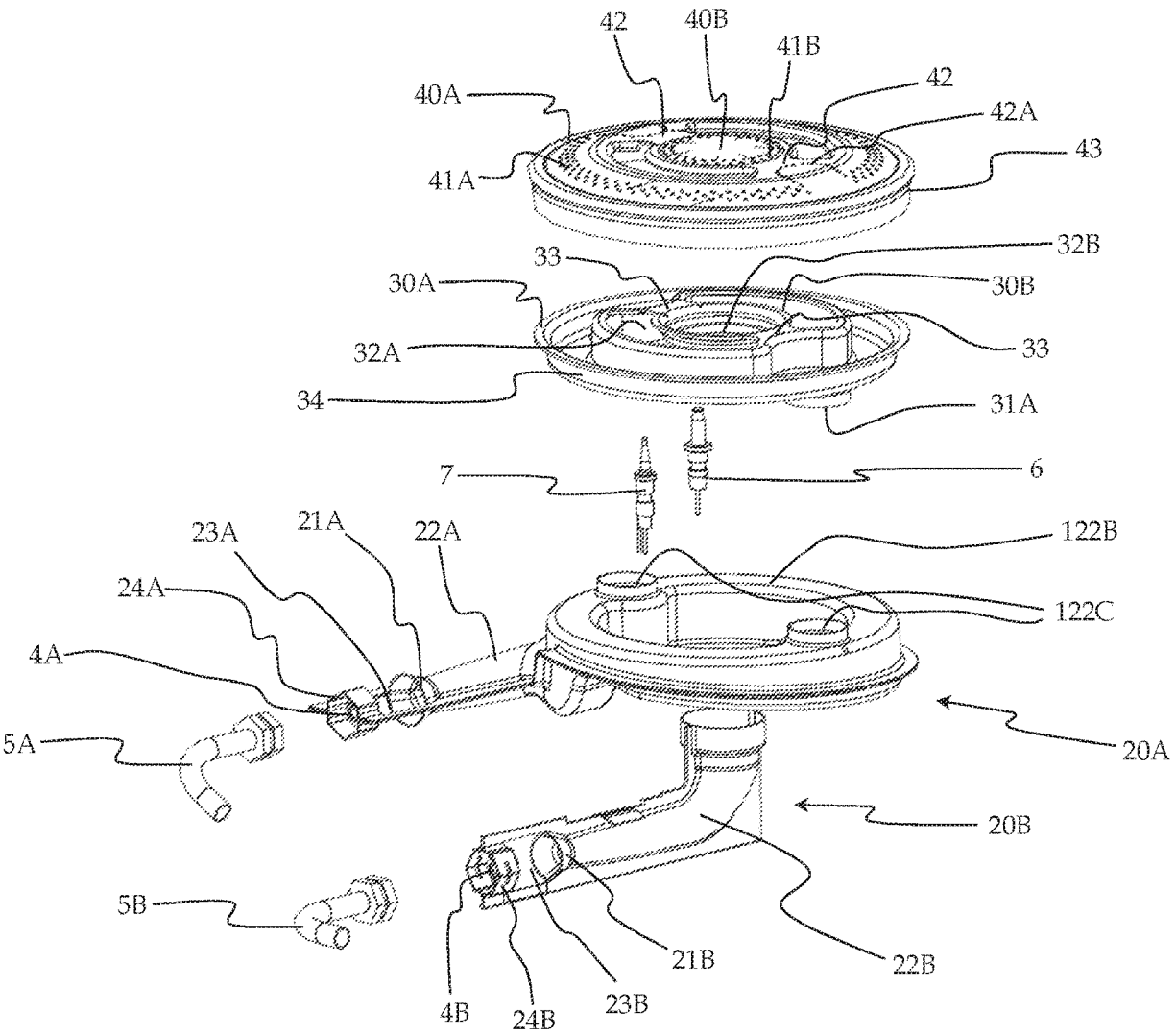
FIG. 3 is a schematic exploded perspective view of a system of gas burners according to the present device.

The cooking top 1 is so shaped as to include a substantially flat visible surface 2, on which a plurality of housings 3 are formed for accommodating at least one system of gas burners 10, such as the one shown in the sectional view of FIG. 2 and in the exploded perspective view of FIG. 3.

The cooking top 1 may also include supporting means (not shown) for cooking vessels containing foods to be cooked, said supporting means being adapted to ensure an adequate separation distance between the visible surface 2 of the cooking top 1 and said cooking vessels.

In addition, the cooking top 1 may include interfacing means (not shown) adapted to, among other things, allow adjusting and/or displaying the operating parameters of the system of burners 10 and of other burners (also not shown) associated with the cooking top 1. For example, the interfacing means may comprise a "touch control" interface, or a mechanical interface, for controlling on-off taps.

As can also be seen in FIGS. 2 and 3, the system of burners 10 adapted for installation in a cooking top 1 according to the present device includes a pair of substantially concentric burners 11, 12. The pair of burners 11, 12 are made up of:

- an outer burner 11 equipped with a first base 20A, a first burner body 30A and a first flame divider 40A; and
- an inner burner 12 equipped with a second base 20B, a second burner body 30B and a second flame divider 40B.

In accordance with the present device, the first base 20A of the outer burner 11 and the second base 20B of the inner burner 12 are made from a sheet, in particular metal or metal-alloy sheet, said sheet being shaped by deep drawing.

Typically, said first flame divider 40A and said second flame divider 40B include, respectively, a plurality of first apertures 41A and second apertures 41B to allow an air-gas mixture to exit, said first apertures 41A and second apertures 41B being so realized as to extend substantially parallel to an axis A-A of the system of burners 10. The particular realization of the first apertures 41A and second apertures 41B can be especially appreciated in a sectional view and when viewed in a direction substantially perpendicular to the axis A-A (as shown in FIG. 2) of the system of burners 10. It is therefore clear that said first apertures 41A and second apertures 41B are so realized as to generate a flame that propagates outwards from the system of burners 10 in a direction substantially parallel to said axis A-A of the system of burners 10, said first apertures 41A and second apertures 41B being thus so realized as to generate a "carpet flame".

The system of burners 10 according to the present device is therefore realized to be particularly effective and economical.

In particular, the system of burners 10 can ensure optimal gas efficiency thanks to the first apertures 41A and second apertures 41B, which provide a "carpet flame"; furthermore, the fact that the first base 20A and the second base 20B are made from sheet metal allows reducing the costs incurred for manufacturing the system of burners 10 and the whole cooking top 1.

In various embodiments, the first base 20A of the outer burner 11 includes a first Venturi element 21A adapted to receive gas coming from a first injector 4A and a first duct 22A for supplying an air-gas mixture to said first base 20A and to the outer burner 11. FIG. 2 also shows a first tube 5A for supplying gas to said first injector 4A.

In various embodiments, the first base 20A of the outer burner 11 is so realized that said first duct 22A enters a substantially toroidal portion 122B having at least one aperture 122C for the gas flow.

Furthermore, the second base 20B of the inner burner 12 includes a second Venturi element 21B adapted to receive gas coming from a second injector 4B and a second duct 22B for supplying an air-gas mixture to said second base 20B and to the inner burner 12. FIG. 2 also shows a second tube 5B for supplying gas to said second injector 4B. In this embodiment, the assembly consisting of the second Venturi element 21B and the second duct 22B is shaped substantially like a pipe, in particular of the type known as "straight pipe".

The first Venturi element 21A and the second Venturi element 21B are arranged substantially horizontal, i.e., with their axis substantially orthogonal to an axis A-A (shown in FIG. 2) of the system of gas burners 10; preferably, also the first injector 4A and the second injector 4B are arranged substantially horizontal and with their axis substantially orthogonal to said axis A-A.

It must be pointed out that, for the purposes of the present device, the terms "vertical", "horizontal", etc. are used with reference to a system of gas burners 10 installed on a cooking top 1.

As is known, the first Venturi element 21A and the second Venturi element 21B create a pressure drop within the first duct 22A and second duct 22B, said pressure drop being used for conveying the gas (enriched with primary air, i.e. the air-gas mixture) towards the combustion area of the system of burners 10.

It is also worth specifying the meaning of the terms "primary air" and "secondary air" as used in the present description. "Primary air" is air mixed with fuel gas inside the system of gas burners 10, whereas "secondary air" is air added to the already formed air-gas mixture in the area outside the cooking top 1 surrounding the system of gas burners 10, said "secondary air" being necessary for providing the additional oxygen required for a proper combustion.

In this regard, the first base 20A includes at least one first air intake 23A to allow entry of primary air, in particular said at least one first air intake 23A being associated with that part of said first base 20A which is adjacent to the first injector 4A and upstream of the first Venturi element 21A, with reference to the gas path.

Likewise, the second base 20B includes at least one second air intake 23B to allow entry of primary air, in particular said at least one second air intake 23B being associated with that part of said second base 20B which is adjacent to the second injector 4B and upstream of the second Venturi element 21B, with reference to the gas path.

In order to ensure a stoichiometrically correct mixture of gas and primary air as a function of the combustion process to which the air-gas mixture will then have to be subjected, said at least one first air intake 23A and said at least one second air intake 23B are sufficiently large to ensure an adequate flow of primary air through them. In the event that natural circulation should not provide a sufficient primary air flow rate to properly supply primary air to the system of gas burners 10, a primary air forced circulation system (not shown in the annexed drawings) may be associated with said system of gas burners 10.

It is apparent from the above description that the system of gas burners 10, according to the present device, is of the type that takes primary air from below the cooking top 1.

The first base 20A and the second base 20B preferably include, respectively, a first seat 24A and a second seat 24B adapted to house, respectively, the first injector 4A and the second injector 4B and/or a terminal portion of said first tube 5A and second tube 5B, in particular said first seat 24A and second seat 24B being located upstream of said at least one first air intake 23A and second air intake 23B (with reference to the path of the gas and of the primary air/gas mixture).

Figure 4:
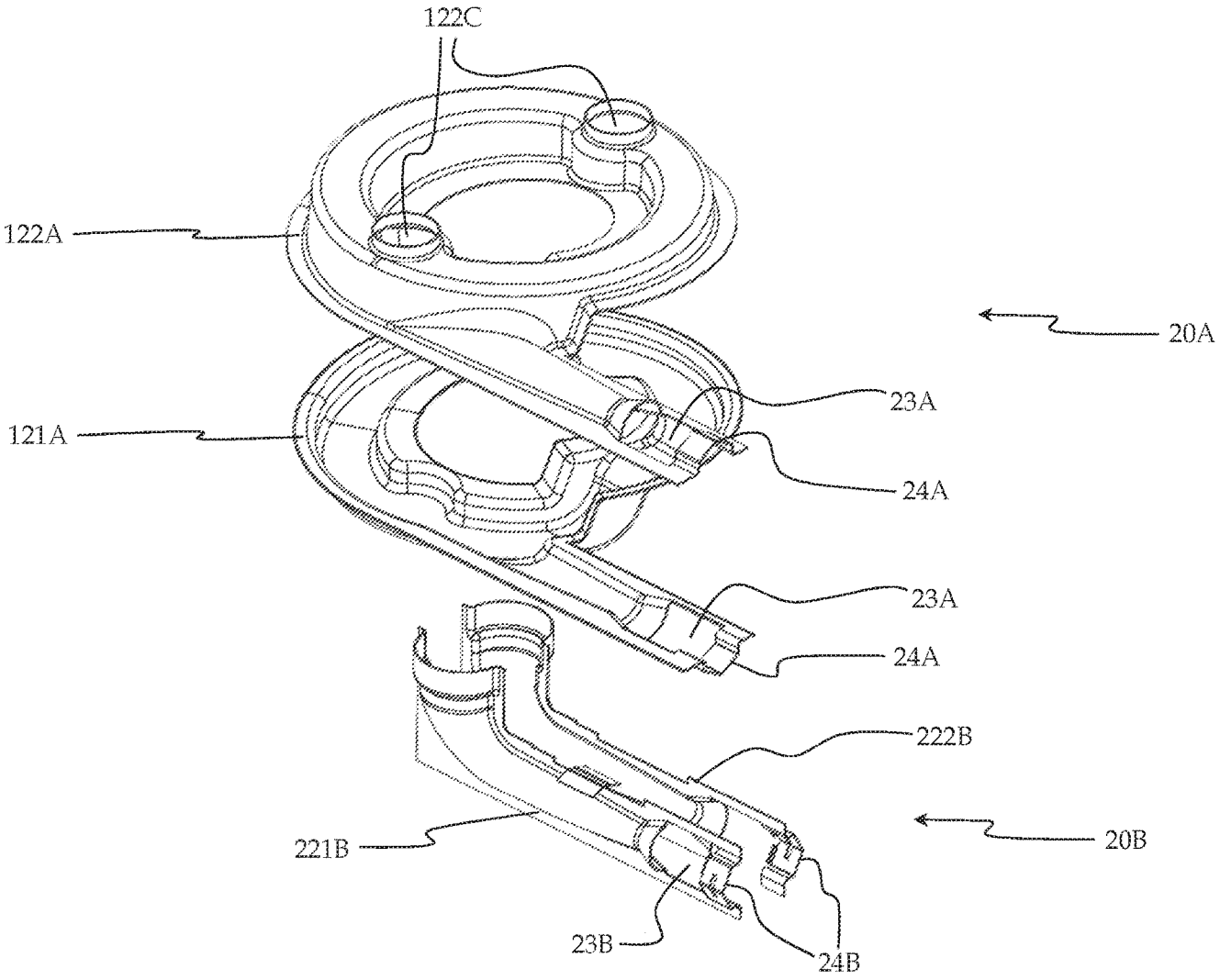
FIG. 4 is a schematic exploded view of a component of the system of gas burners according to the present device.

In various embodiments (also shown in FIG. 4), the first base 20A includes a first half body 121A and a second half body 122A made from sheet metal and joined together; moreover, in such an embodiment, the second base 20B comprises a first half shell 221B and a second half shell 222B made from sheet metal and joined together.

Preferably, the first half body 121A and the second half body 122A are joined together by welding, just like the first half shell 221B and the second half shell 222B; it is however clear that such components may be joined together otherwise, e.g., by gluing or through the use of fastening means.

The first base 20A and the second base 20B may then include connection means (not shown) for associating at least one ignition spark plug 6 and at least one thermocouple 7 with the system of gas burners 10; furthermore, said first base 20A and second base 20B may be joined together.

The annexed drawings also show that the first burner body 30A of the outer burner 11 is coupled to the toroidal portion 122B of the first base 20A and comprises at least one opening 31A adapted to be coupled to said at least one aperture 122C of said toroidal portion 122B to allow the passage of the gas (in particular, the passage of the primary air-gas mixture).

The first burner body 30A includes also a central hole 32A adapted to house the second burner body 30B of the inner burner 12, said second burner body 30B being coupled to the second base 20B and comprising a second hole 32B for the passage of the gas coming from the second duct 22B of the second base 20B.

In substance, when viewed from above, the first burner body 30A and the second burner body 30B are substantially shaped like a circular crown, the second burner body 30B being arranged in a substantially concentric manner in the central hole 32A of the first burner body 30A.

In various embodiments, the first burner body 30A and the second burner body 30B are made from a sheet, in particular metal or metal-alloy sheet, which are shaped by deep drawing. In particular, said first burner body 30A and second burner body 30B may be made from enameled sheet metal.

For the purpose of reducing the number of parts making up the system of gas burners 10 of the present device, the first burner body 30A and the second burner body 30B are preferably joined together by at least one bridge 33 (visible in FIG. 3); in particular, said at least one bridge 33 comprises a first and a second bridge 33 substantially positioned on opposite sides with respect to the second burner body 30B.

In the annexed drawings, the first flame divider 40A is positioned on the first burner body 30A of the outer burner 11 and the second flame divider 40B is positioned on the second burner body 30B of the inner burner 12; preferably, in a top view of the system of gas burners 10 according to the present device, the shape and dimensions of said first flame divider 40A and second flame divider 40B almost coincide, respectively, with those of said first burner body 30A and second burner body 30B.

In accordance with the present device, the first flame divider 40A and second flame divider 40B are made from a sheet, in particular metal or metal-alloy sheet.

Still for the purpose of reducing the number of parts that make up the system of gas burners 10 of the present device, the first flame divider 40A is preferably made as one piece adapted to be positioned on the first burner body 30A, and the second flame divider 40B is coupled to said first flame divider 40A by means of at least one arm 42; in particular, said at least one arm 42 includes a pair of arms 42 located on substantially opposite sides with respect to the second flame divider 40B.

It should be noted that said at least one arm 42 may be so realized as to include third apertures 42A, the function of which is to ensure adequate ignition and combustion of the air-gas mixture coming out of the first apertures 41A and second apertures 41B.

Preferably, the first flame divider 40A includes a side wall 43 that allows the apertures 41A, 41B to be kept in a raised position relative to the cooking top 1.

Typically, said side wall 43 has a height H (see FIG. 2) in the range of 10 mm to 20 mm, in particular said height H being approximately 15 mm.

Accordingly, the flames propagating from said apertures 41A, 41B will not cause overheating of the visible surface 2 of the cooking top 1 near the system of gas burners 10.

In various embodiments, the first burner body 30A comprises a flank 34, the height of which is essentially close to said height H of said side wall 43, so that the coupling between the first burner body 30A and the first flame divider 40A will ensure proper sealing and will prevent the air-gas mixture from escaping sideways; in an operating condition of the system of gas burners 10 (i.e., a condition in which the first burner body 30A and the first flame divider 40A of the system of gas burners 10 are assembled together), the flank 34 of the first burner body 30A and the side wall 43 of the first flame divider 40A are arranged substantially side by side and cooperate to keeping the apertures 41A, 41B raised relative to the cooking top 1, in particular at a distance substantially corresponding to or slightly greater than said height H.

The particular realization of the side wall 43 of the first flame divider 40A and of the flank 34 of the first burner body 30A allows the first apertures 41A of the first flame divider 40A and the second apertures 41B of the second flame divider 40B to be positioned at a certain distance (substantially corresponding to the height H) from the visible surface 2 of the cooking top 1; this provision prevents overheating of the area of the cooking top 1 around the system of gas burners 10. This prevents said cooking top 1 from suffering possible damage, particularly when it is made from glassy materials or the like.

Note that the first flame divider 40A and the second flame divider 40B provide the functions of delimiting the internal environment of the system of gas burners 10 at the top and of allowing the flame generated by the combustion of the air-gas mixture to exit the system of gas burners 10 through the plurality of first apertures 41A and second apertures 41B.

Furthermore, the first flame divider 40A and the second flame divider 40B are preferably microperforated, i.e., they are so realized as to comprise a plurality of first apertures 41A and second apertures 41B, the diameter of which is substantially equal to the thickness of the sheet or smaller than the thickness of the sheet. In particular, the thickness of the microperforated sheet is preferably approximately 1 millimeter, and the diameter of the first apertures 41A and second apertures 41B of the microperforated sheet is conveniently comprised between 100 micrometers and 1 millimeter.

In various embodiments (like the one shown in the annexed drawings), the system of gas burners 10 according to the present device is so realized as to include a first tube 5A and a second tube 5B associated with independent control valves (not shown), so that the outer burner 11 and the inner burner 12 can be used either jointly or separately. Consequently, in this preferred embodiment the system of gas burners 10 is of the double-crown, double-control type, and ensures good variability and a homogeneous distribution of the heat to be supplied to a cooking container positioned over said system of gas burners 10. The system of gas burners 10 according to the present device may also be of the double-crown, single-control type, i.e., realized in such a way that the outer burner 11 and the inner burner 12 are fed by a common gas inlet duct associated with a common tap or control valve (not shown).

The features and advantages of the system of gas burners 10, in particular for a cooking top 1 for household use, and of the associated cooking top 1 according to the present device are apparent in the light of the above description.

In particular, the system of burners 10 according to the present device is so realized to be particularly effective, in that it ensures optimal gas efficiency due to the first apertures 41A and second apertures 41B, which produce a "carpet flame".

In addition, the system of gas burners 10 according to the present device is so realized to be particularly economical, in that the fact that the first base 20A and the second base 20B are made from sheet metal allows reducing the costs incurred for manufacturing the system of gas burners 10 and the whole cooking top 1.

Said reduction of the production costs of the system of gas burners 10 is also made possible by the fact that also the first burner body 30A, the second burner body 30B, the first flame divider 40A and the second flame divider 40B are preferably made from sheet metal.

It should also be pointed out that the particular realization of the side wall 43 of the first flame divider 40A and of the flank 34 of the first burner body 30A prevents overheating of the area of the cooking top 1 around the system of gas burners 10, while also preventing said cooking top 1 from suffering damage, particularly when the latter is made from glassy materials or the like.

It is however clear that many changes may be made to the system of gas burners 10, in particular for a cooking top 1 for household use, and to the associated cooking top 1 according to the present device, and that in its practical implementation the various components may have different shapes and arrangements or be replaced with other technically equivalent elements without departing from the novelty spirit of the device.

In particular, the present description has disclosed in detail a system of gas burners 10 and a cooking top 1 particularly suited for use in a household environment. Nevertheless, the present device may also be conveniently implemented in systems of gas burners 10 and cooking tops 1 intended for different applications, e.g., in the hotel industry.

It can therefore be easily understood that the present device is not limited to the above-described system of gas burners 10 and associated cooking top 1, but may be subject to many modifications, improvements or replacements of equivalent parts and elements without departing from the device.

The invention claimed is:

1. A gas burner for a cooktop, the gas burner comprising:

an outer burner having a first base and a first flame divider;

an inner burner having a second base and a second flame divider;

first and second supplies of gas that are delivered to the outer and inner burners, respectively, and wherein the first and second supplies of gas are separated from one another by the outer and inner burners; and at least one arm that extends between the outer and inner burners and includes ignition apertures that place the outer burner and the first supply of gas in communication with the inner burner and the second supply of gas, the ignition apertures configured to propagate a flame between the outer and inner burners and within an area above the at least one arm, wherein:

the first and second flame dividers having first apertures and second apertures, respectively;

the first and second apertures extending substantially parallel to a common central axis of the outer and inner burners;

the ignition apertures extend proximate each of the first and second apertures; and the first supply of gas in the at least one arm is partitioned from the inner burner such that communication between the inner burner and the outer burner occurs above the at least one arm and through flame propagation at the ignition apertures.

2. The gas burner of claim 1, wherein the first and second supplies of gas are confined to the first and second bases, respectively.

3. The gas burner of claim 1, wherein the at least one arm extends over the first and second bases.

4. The gas burner of claim 1, wherein the outer and inner burners are concentric circles that are aligned with the common central axis.

5. The gas burner of claim 2, wherein the first base of the outer burner includes a first Venturi element adapted to receive the first supply of gas from a first injector, and a first duct for supplying the first supply of gas to the first base, and wherein the second base of the inner burner includes a second Venturi element adapted to receive the second supply of gas from a second injector, and a second duct for supplying the second supply of gas to the second base.

6. The gas burner of claim 5, wherein the first base of the outer burner is positioned so that the first duct enters a substantially toroidal portion having at least one aperture for passage of the first supply of gas.

7. The gas burner of claim 5, wherein an assembly having the second Venturi element and the second duct is substantially pipe shaped.

8. The gas burner of claim 5, wherein primary air is delivered from below the cooking top proximate at least one first air intake of the first base and at least one second air intake of the second base to allow entry of primary air, and wherein the first and second air intakes are located upstream of the first Venturi element and of the second Venturi element, respectively.

9. The gas burner of claim 1, wherein the first base includes a first half body and a second half body each made from sheet metal and joined together, said second base including a first half shell and a second half shell each made from a metallic sheet and joined together.

10. The gas burner of claim 1, wherein the first flame divider, the second flame divider and the at least one arm are made from a single metallic member that is one of a metal sheet and a metal-alloy sheet.

* * * * *